US006471374B1

(12) United States Patent
Thomas et al.

(10) Patent No.: US 6,471,374 B1
(45) Date of Patent: Oct. 29, 2002

(54) ACCENT LIGHT ADJUSTABLE ASSEMBLY

(75) Inventors: Eric P. Thomas, Little Compton, RI (US); Orlando S. Rodrigues, Swansea, MA (US); Daniel F. Francis, Warren, RI (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/607,264

(22) Filed: Jun. 30, 2000

(51) Int. Cl.[7] ..... F21V 21/29

(52) U.S. Cl. ..... 362/285; 362/287; 362/366; 362/364; 362/365; 362/426; 362/427

(58) Field of Search ..... 362/287, 366, 362/426, 427, 285, 274, 288, 428, 402, 364, 365; 248/574

(56) References Cited

U.S. PATENT DOCUMENTS

| | | | | |
|---|---|---|---|---|
| 3,518,420 A | | 6/1970 | Kripp | |
| 3,697,742 A | | 10/1972 | Bobrick | |
| 4,142,227 A | | 2/1979 | Aikens | |
| 4,475,147 A | | 10/1984 | Kristofek | |
| 5,373,431 A | | 12/1994 | Hayman et al. | |
| 5,556,188 A | | 9/1996 | Poppenheimer | |
| 5,826,970 A | | 10/1998 | Keller et al. | |
| 6,079,852 A | * | 6/2000 | Kamaya et al. | 362/287 |
| 6,234,644 B1 | * | 5/2001 | Kotovsky et al. | 362/148 |
| 6,270,238 B1 | * | 8/2001 | Menelsohn et al. | 362/287 |
| 6,220,728 B1 | * | 4/2002 | Andrus et al. | 362/287 |

* cited by examiner

*Primary Examiner*—Sandra O'Shea
*Assistant Examiner*—Anabel Ton
(74) *Attorney, Agent, or Firm*—Middleton Reutlinger

(57) ABSTRACT

The present invention provides a support assembly for a lighting fixture and two adjustment mechanisms that provide for a significant range of adjustment of the lamp within the lighting fixture. The support assembly includes a first and a second support member. The first support member may be an arcuate support brace or yoke, including at least one first leg extending therefrom. The second support member may be an annular base brace or yoke, including at least a second leg extending therefrom. The first adjustment mechanism provides for the repositioning of the lamp support about a horizontal axis and includes a travel arm and two biasing means. The second adjustment mechanism provides for the rotation of the base yoke 360° about a vertical axis that runs through the center of the annular portion of the yoke and then secured in position within the lighting fixture by a locking means, such as the adjustable locking clamp.

11 Claims, 4 Drawing Sheets

ACCENT LIGHT ADJUSTABLE ASSEMBLY

BACKGROUND

1. Field of the Invention

The present invention relates to lighting fixtures and, more particularly, to recessed lighting fixtures with adjustable support assemblies.

2. Description of the Related Art

Recessed lighting fixtures are often designed to be adjusted only with some difficulty. Many fixtures require adjustment by hand that can lead to skin contact with heated elements of the lighting fixture and resulting bums or discomfort. Additionally, current adjustable fixtures tend to become misaligned after they have been adjusted into position due to adjustment mechanisms that do not provide a smooth stable adjustment. These adjustable fixtures also usually provide only a limited range of adjustment that will not allow the user to optimize the use of the lighting fixture after it has been installed.

Thus, there is a need for an adjustment mechanism for a recessed lighting fixture that provides for a wide range of adjustment. The novel mechanism should provide for the safe adjustment of the fixture by the use of a screwdriver or other similar tool to adjust the biasing mechanism within the assembly. The mechanism should also provide for a smooth stable adjustment that maintains the lamp in position once it has been so adjusted.

SUMMARY OF THE INVENTION

It is an object of the present invention to provide a support assembly for a lighting fixture that provides for a significant range of adjustable positioning for the lamp within the fixture.

It is another object of the present invention to provide a support assembly for a lighting fixture that maintains its position once it has been adjustably placed therein.

It is yet another object of the present invention to provide a support assembly for a lighting fixture that will automatically return to a preset angle.

It is a further object of the present invention to provide a support assembly for a lighting fixture that provides for unlimited positioning within a specified range of adjustment.

It is still a further object of the present invention to provide a support assembly for a lighting fixture that may be adjusted using a hand-held tool, such as a screwdriver.

More particularly, the present invention provides a support assembly for a lighting fixture with two adjustment mechanisms that provide for a significant range of adjustment of the lamp within the lighting fixture. The support assembly includes a first and a second support member. The first support member may be an arcuate support brace or yoke, including at least one first leg extending therefrom. The second support member may be an annular base brace or yoke, including at least a second leg extending therefrom. The first adjustment mechanism provides for the repositioning of the lamp support about a horizontal axis. This first adjustment mechanism includes a first biasing means, such as a screw, a second biasing means, such as spring, and a travel arm. The travel arm is in communication with one leg of the support brace or yoke to which is attached the lamp socket and the lamp of the fixture. The first biasing means is in communication with the travel arm. The second biasing means is in communication with both the first and the second support braces. This communication may be more particularly with a leg of the support yoke and a leg of the base yoke, which connects the support yoke to the rest of the light fixture. The second biasing means, or spring, tends to bias the support yoke into its lowest position relative to the base yoke. The first biasing means, or screw, can be threadably adjusted so as to force the travel arm upward or allow the travel arm to move downward relative to the base yoke. As the travel arm moves upward or downward due to these two biasing means, it in turn, moves one support leg of the support yoke. This support leg thereby pivots about a pivot pin, which attaches support leg to a leg of the base yoke. In this manner, the entire support yoke can pivot in a 45° arc relative to the base yoke. Thus, a lamp attached to this support yoke can be pivoted to any point within this 45° arc.

The second adjustment mechanism includes the base brace or yoke, a cylindrical sleeve, a flange attached to either the second support brace or the cylindrical sleeve, an adjustable locking clamp that secures the base yoke in position relative to the cylindrical sleeve, and a support clamp that connects the base yoke to the cylindrical sleeve, thereby securing the base yoke inside of the lighting fixture. The cylindrical sleeve is attached to the rest of the lighting fixture and provides a means of support for the support assembly and the lamp socket attached thereto. The base yoke may be rotated 360° about a vertical axis that runs through the center of the annular portion of the yoke and then secured in position within the lighting fixture by a locking means, such as the adjustable locking clamp. The adjustable locking clamp may be loosened, so as to allow the rotation of the base yoke, and then tightened so as to lock the base yoke into position. The adjustment of this adjustable locking clamp may be accomplished by a screw or other convenient means.

The combination of these two adjustment mechanisms provides for a wide range of adjustment of the lamp within the lighting fixture. The 45° arc of the first adjustment mechanism is effectively doubled for any diametrical alignment by the addition of the second adjustment assembly.

It will become apparent that other objects and advantages of the present invention will be obvious to those skilled in the art upon reading the detailed description of the preferred embodiment set forth hereinafter.

DESCRIPTION OF THE PREFERRED EMBODIMENT

Figure 1:
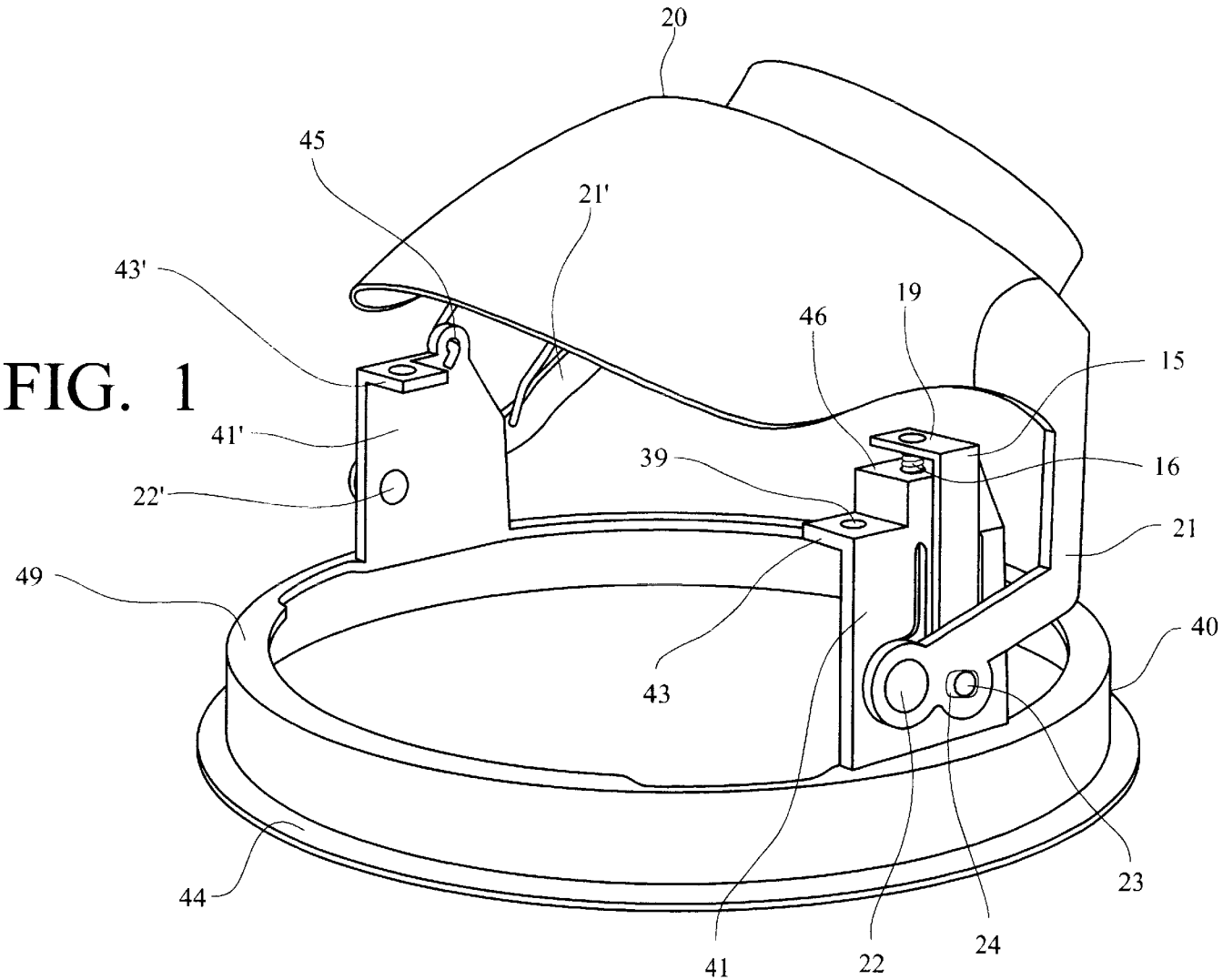
FIG. 1 is a perspective view of a preferred embodiment of a support assembly for a lighting fixture of the present invention.

As shown in the figures, a support assembly of the present invention is provided with a support brace, yoke, or first support member 20 and a base brace, yoke, or second support member 40. A lamp socket, not shown, is attached to support yoke 20 when the assembly is included within a lighting fixture. When the lighting fixture is completely assembled and installed a lamp, not shown, is housed within the lamp socket that is attached to the support yoke 20. The lamp is directed down through the annular portion 49 of base yoke 40.

As shown in FIG. 1, support yoke 20 includes support legs 21 and 21' and base yoke 40 includes base legs 41 and 41'. Base leg 41 includes a channel 17 therein. Support leg 21 is adjustably attached to base leg 41 by pivot pin 22. Support leg 21' is likewise adjustably attached to base leg 41' by pivot pin 22'. Both support legs 21 and 21' pivot about pivot pins 22 and 22' relative to base legs 41 and 41'.

Figure 2:
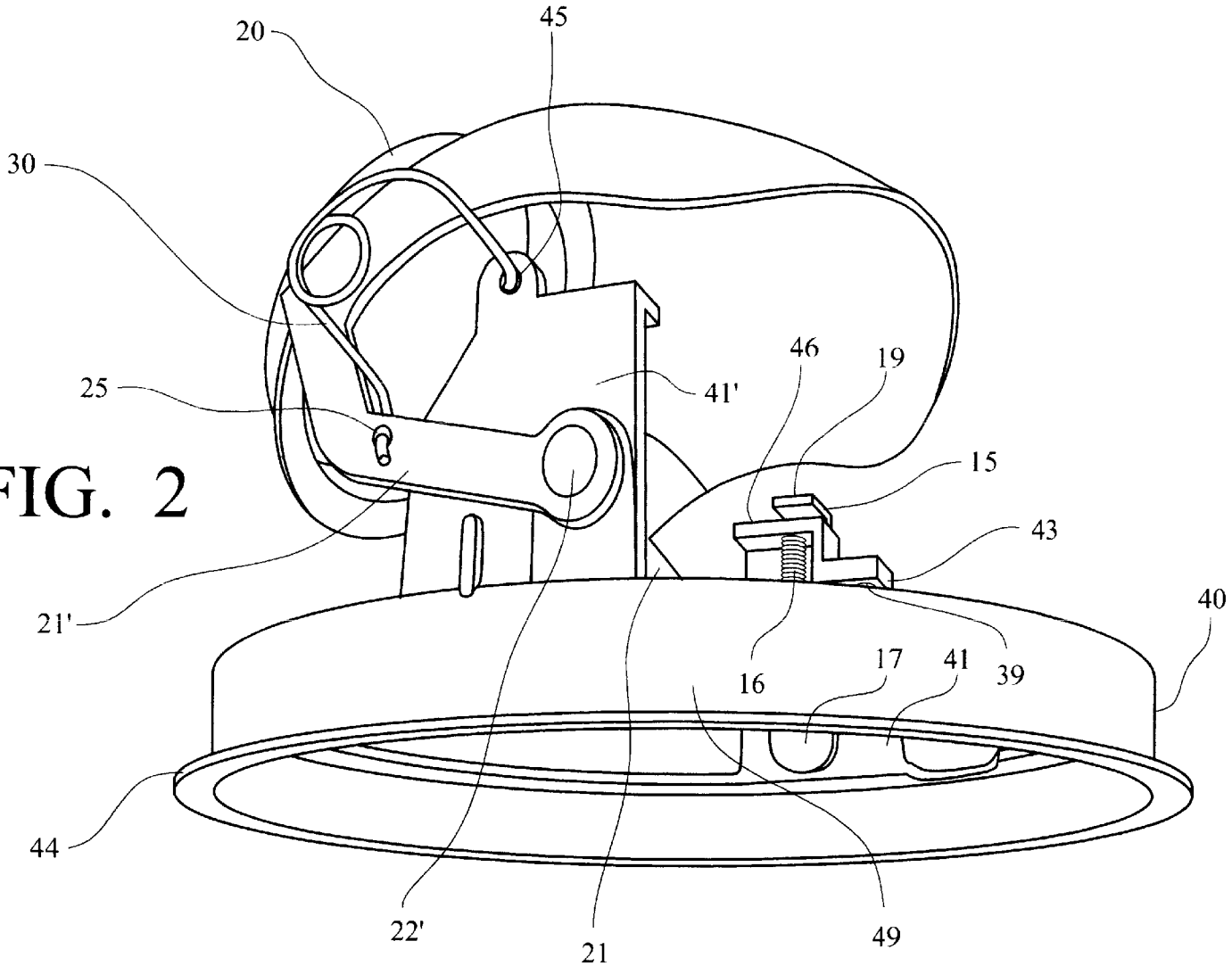
FIG. 2 is another perspective view of the support assembly of FIG. 1 as seen from a different angle.
Figure 4:
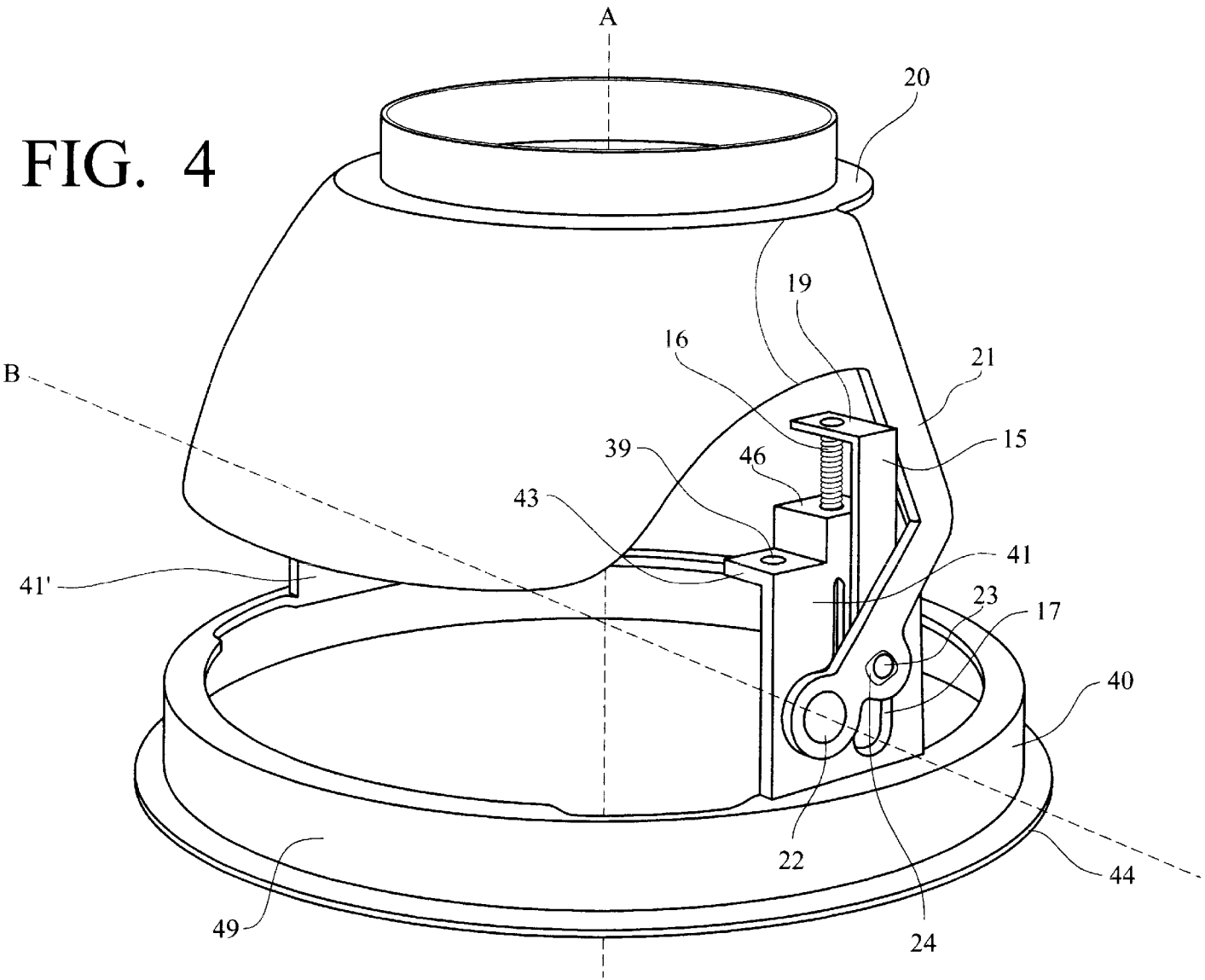
FIG. 4 is a perspective view of the support assembly of FIG. 1 shown with a support yoke adjusted to its highest position.

FIG. 1 also shows travel arm 15 which is movably disposed within channel 17, as shown in FIGS. 2 and 4. Travel arm 15 is attached to support leg 21 with a pin 23. Pin 23 extends through opening 24 in travel arm 15, opening 24 being sized so as to allow pin 23 to have a limited range of movement within the opening 24. More specifically, pin 23 moves vertically while support leg 21 moves in a 45° arc. The configuration of pin 23 and opening 24 allows both such nonparallel movements of the pin and leg while the travel arm pin 23 remains disposed within opening 24. Travel arm 15 also includes a shoulder 19 which rests upon shoulder 46 of base leg 41 when the travel arm 15 is in its lowest position, which will be discussed hereinafter.

In FIG. 2, biasing spring 30 is shown attached to support leg 21' and base leg 41'. Biasing spring 30 may be attached in other locations as long as spring 30 serves to bias support yoke 20 relative to base yoke 40. As shown, one leg of the biasing spring 30 is inserted through opening 25 in support leg 21', while the other leg of the biasing spring 30 is inserted through opening 45 in base leg 41'. In operation, biasing spring 30 pushes leg 21' and leg 41' in opposite directions so that spacing between openings 25 and 45 is increased. FIG. 2 also shows biasing screw 15 threadably received within a threadable opening within the shoulder 46 of base leg 41. FIG. 2 also shows a flange 44 which projects outward from the annular portion 49 of base yoke 40.

Figure 3:
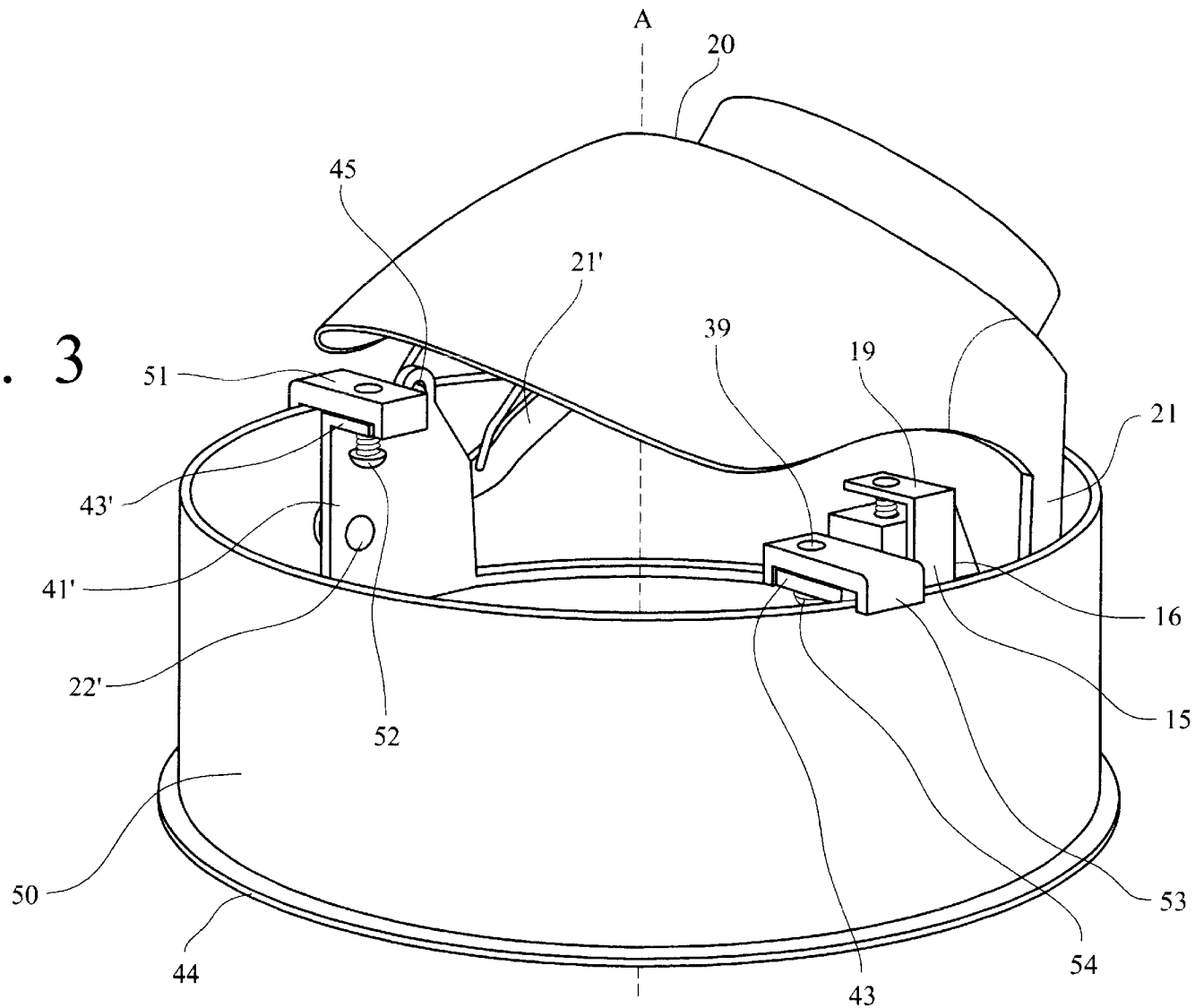
FIG. 3 is a perspective view of the support assembly of the present invention including additionally a cylindrical sleeve, clamps and clamp screws.

FIG. 3 shows the same support assembly shown in FIG. 1, but with the addition of a cylindrical sleeve 50, adjustable locking clamp 51, adjustable locking clamp screw 52, support clamp 53 and support clamp screw 54. Cylindrical sleeve 50 rests upon flange 44 of base yoke 40 which serves as a support structure that connects the base yoke 40 to the rest of the lighting fixture. Base yoke 40 is connected to cylindrical sleeve 50 by adjustable locking clamp 51 and support clamp 53. Adjustable locking clamp screw 52 is threadably attached to both shoulder 43' of base leg 41' and adjustable locking clamp 51. Likewise, support clamp screw 54 is threadably attached to both shoulder 43 of base leg 41 and support clamp 53. When the lighting fixture is completely assembled, cylindrical sleeve 50 remains stationary, while base yoke 40 may be rotated about a vertical axis "A" after the adjustable locking clamp 51 is loosened enough to allow such rotation. Support clamp 53 secures the base yolk 40 to the cylindrical sleeve 50 while allowing for the rotation of the base yoke 40.

As shown in FIG. 4, travel arm 15 is biased by biasing screw 16 into its highest position. Biasing screw 16 is threaded through a hole 39 located in the shoulder 46 of base leg 41 and contacts shoulder 19 of travel arm 15.

Once the lighting fixture containing the support assembly of the present invention is installed, the lamp light of the fixture may be redirected by adjusting the support assembly mechanisms. The position of the lamp about a horizontal axis may be adjusted by manipulating the first adjustment mechanism of the present invention. The lamp and lamp socket, which are suspended from the support yoke, may be repositioned at any point within a 45° arc about a horizontal axis "B" that extends through pivot pins 22 and 22', as best shown in FIG. 4. In order to accomplish this adjustment, biasing screw 16, may be threaded further into or out of hole 39. Travel arm 15 will be biased upward or downward by its contact with biasing screw 16. In turn, support leg 21 will move with travel arm 15 as force is applied thereto by biasing screw 16. Biasing spring 30 provides constant force on the support yoke 20, thereby directing the support yoke 20 to the bottom of the 45° arc. The force that biasing screw 16 provides to travel arm 15 counteracts that downward force provided by biasing spring 30. As travel arm 15 moves vertically, support leg 21 moves along the 45° arc. In turn, the entire support yoke 20, and the lamp socket and lamp attached thereto move along this 45° arc. The relative position of the biasing screw 16 and travel arm 15, which is in communication with support leg 21, determines the relative position within the 45° arc of support yoke 20 and the lamp socket and lamp attached thereto.

Returning back to FIG. 1, the support yoke 20 is biased to the bottom of the 45° arc by the force imparted by biasing spring 30, as best shown in FIG. 2. In this position, biasing screw 16 is applying no upward force on travel arm 15 and, thus, travel arm 15 is in its lowest position within channel 17 and shoulder 19 is contacting shoulder 46 of base leg 21. Support leg 21 is therefore in its most reclined position, as is support yoke 20. FIG. 4 shows support yoke 20 biased to the top of the 45° arc by the force imparted by biasing screw 16 to travel arm 15. In FIG. 4, travel arm 15 is raised to its uppermost position within channel 17. Biasing screw 16 is applying force to shoulder 19 of travel arm 15. Support leg 21 has been raised to its highest position. Travel arm pin 23, which is attached to travel arm 15 and disposed within opening 24, will allow no further movement upward of the travel arm 15 and support leg 21.

The adjustability of the lamp light can be further increased by the second adjustment mechanism. The lamp light may be repositioned about the vertical axis "A" that extends through the central axis of annular portion 49 of base yoke 40. The repositioning may be executed by rotating base yoke 40 about vertical axis A. Base yoke 40 may be rotated 360° in either direction. Once base yoke 40 is in a preferred position, adjustable locking clamp 51 may be secured to cylindrical sleeve 50 by threadably tightening adjustable locking clamp 51 with adjustable locking clamp screw 52. As adjustable locking clamp screw 52 is threaded upward through adjustable locking clamp 51, adjustable locking clamp 51 tightens about both cylindrical sleeve 50 and shoulder 43' of base leg 41'. In this manner, base yoke 40 can be secured in position relative to cylindrical sleeve 50.

The threadable adjustments of the first and second adjustment mechanisms allow for use of a tool and hands-off adjustment of the lighting fixture, thereby preventing skin contact with heated elements of the fixture. Another advantage of the support assembly of the present invention is provided by the constant force that biasing spring 30 provides to support leg 21'. This feature provides for the smooth adjustment of the support yoke 20, as well as a default position for yoke.

While the invention has been found in one preferred embodiment in respect to the design of the adjustment mechanisms of the support assembly for a lighting fixture, it is apparent that various modifications can be made to the present invention without departing from the spirit or scope of the invention as set forth in the claims appended hereto.

What is claimed is:

1. A support assembly for a lighting fixture comprising:

a first support member including at least one leg extending therefrom;

a second support member spaced from said first support member and including at least one second leg extending therefrom and including at least one channel therein, including a flange projecting from said second support member and a cylindrical sleeve mounted onto said flange;

a travel arm movably disposed within said channel and adjustably attached to said at least one first leg;

a first biasing means in communication with said travel arm, wherein first biasing means is a screw;

a second biasing means in communication with said first support member and said second support member, wherein said second biasing means is a spring; and a locking means in communication with said second support member and said cylindrical sleeve, wherein said locking means is a clamp.

2. A support assembly for a lighting fixture comprising:

an arcuate support yoke including two support legs extending therefrom;

an annular base yoke including two longitudinally extending base legs and a flange projecting laterally therefrom;

one of said base legs having at least one channel therein;

a travel arm movably disposed within said channel and adjustably attached to one of said support legs;

a screw threadably attached to one of said base legs and in communication with said travel arm;

a spring in communication with one said support leg and one said base leg;

a cylindrical sleeve mounted onto said flange; and, a locking clamp adjustably attached to said base yoke and said cylindrical sleeve.

3. An adjustment mechanism for a lighting fixture comprising:

a first support member including a channel therein;

a travel arm movably disposed within said channel and attached to a second support member;

a first biasing means in communication with said travel arm; and, a second biasing means in communication with said second support member, whereby said first and second biasing means provide for the positioning of said second support member relative to said first support member.

4. The adjustment mechanism of claim 3, wherein said first biasing means is a screw.

5. The adjustment mechanism of claim 3, wherein said second biasing means is a spring.

6. An adjustment mechanism for a lighting fixture comprising:

an annular support member;

a cylindrical sleeve concentrically aligned with and mounted onto said annular support member; and a locking means adjustably attached to said annular support member and said cylindrical sleeve, wherein said locking means is a clamp.

7. An adjustment assembly for a lighting fixture comprising:

a first support member including a channel therein;

a travel arm movably disposed within said channel and attached to a second support member;

a first biasing mechanism in communication with said travel arm;

a second biasing mechanism in communication with said second support member;

an annular support member;

a cylindrical sleeve concentrically aligned with and mounted onto said annular support member; and, a locking mechanism adjustable attached to said annular support member and said cylindrical sleeve.

8. The adjustment assembly of claim 7, wherein said first biasing mechanism is a screw.

9. The adjustment assembly of claim 7, wherein said second biasing mechanism is a spring.

10. The adjustment assembly of claim 7, wherein said locking mechanism is a clamp.

11. The annular support member of claim 7, including a flange projecting laterally therefrom.

* * * * *